US006062391A

United States Patent [19]

Nahum-Albright

[11] Patent Number: 6,062,391

[45] Date of Patent: May 16, 2000

[54] PACKAGED COSMETIC PRODUCT

[75] Inventor: Michelle Nahum-Albright, Westfield, N.J.

[73] Assignee: Elizabeth Arden Company, Division of Conopco, Inc., New York, N.Y.

[21] Appl. No.: 09/395,951

[22] Filed: Sep. 14, 1999

[51] Int. Cl.[7] ..... B65D 75/00

[52] U.S. Cl. ..... 206/581; 206/457; 206/782

[58] Field of Search ..... 206/581, 457, 206/769, 775, 776, 777, 778, 823, 782

[56] References Cited

U.S. PATENT DOCUMENTS 2,325,224 7/1943 Bryant, Sr. ..... 206/775 X 5,163,457 11/1992 Lombardi, Jr. ..... 206/581 X

*Primary Examiner*—Jacob K. Ackun

*Attorney, Agent, or Firm*—Milton L. Honig

[57] ABSTRACT

A packaged cosmetic product is provided which includes a transparent cosmetic composition, a container for holding the composition and a carton surrounding the container. In a preferred embodiment, the container has a front and rear wall, the front wall being transparent while the rear wall is etched along a portion of its surface. A front wall of the container is transparent while a rear wall is etched along a portion of the surface. The carton has parallel anterior and posterior walls, each with a window cut through their respective surfaces. These windows are preferably of substantially equivalent shape, are bordered on the carton surface by a complementary shaped pattern, are aligned along a common axis and frame the translucent portion. Particularly preferred are windows in the shape of half leaves complemented by symmetrical half leaves embossed or printed on the container surface adjacent the windows. The etched portion is preferably patterned also as a leaf of generally similar design.

11 Claims, 2 Drawing Sheets

PACKAGED COSMETIC PRODUCT

BACKGROUND OF THE INVENTION

1. Field of the Invention

The invention concerns a packaged cosmetic product including dual windows for viewing the package contents and serving as a 3-dimentional logo.

2. The Related Art

It is well known to package cosmetics in clear glass or plastic containers which are then further encased in a paperboard or plastic carton. Occasionally windows are fashioned in the carton to allow prospective customers to view the cosmetic contents. Seldom are the windows utilized for purposes of an advertising logo or to provide an illuminated background for better viewing of the cosmetic product contents. The problem is especially relevant to transparent cosmetic liquids and gels.

Accordingly, it is an object of the present invention to provide a packaged cosmetic product featuring a windowed carton to allow prospective customers a better view of their purchase.

Another object of the present invention is to provide a packaged cosmetic product featuring a carton with windows serving as a 3-dimentional illuminated logo.

SUMMARY OF THE INVENTION

A packaged cosmetic product is provided which includes:

(i) a transparent cosmetic composition;

(ii) a container formed with front and rear walls, one of the walls being transparent along at least a portion of a surface thereof and one of the walls being translucent along at least a portion of a surface thereof, the composition being held within the container; and (iii) a carton formed with anterior and posterior walls parallel to one another, the walls of the carton being opaque except for a window in each of the anterior and posterior walls, the windows being aligned with one another, the container being stored within the carton in a position framing the translucent portion within one of the windows and the transparent portion within the other of the windows.

Walls of the container may either be of glass or a clear plastic. The translucent portion is best formed by etching of the glass or clear plastic walls. In a preferred embodiment, the front and rear walls of the container are transparent except for a translucent design on the rear wall. The container in this embodiment is stored within the carton in a position framing the translucent portion within the posterior window and the transparent wall within the anterior window. An alternative embodiment has both the front and rear walls of the container being translucent (frosted) except for a design (e.g. a half-leaf) defined by unetched transparent portions. A still further embodiment features one of the container walls as being clear, the other being translucent and a design being formed by unetched transparent glass located on the generally translucent wall. The translucent and transparent portions may cover an area larger than respective windows which might frame those portions.

Advantageously, a design complementary to that etched in a wall of the container is formed on a wall of the carton symmetrical in shape to that of the window. Most preferable is that the design be half of a leaf.

Walls of the carton may be plastic but preferably are of paperboard.

Cosmetic compositions of this invention may range from transparent fluids to semi-solid gels. In a first embodiment of this invention, the compositions are sprayable fluids such as an aqueous alcoholic fragrance of the eau de toilette variety or of a perfume. The term transparent as used in the specification is intended to connote its usual dictionary definition. Thus, a transparent substance, like glass, allows ready viewing of objects behind it. By contrast, a translucent substance although allowing light to pass through, causes the light to be so scattered that it will be impossible to clearly identify objects behind the translucent substance. A composition is deemed to be transparent if the maximum transmittance of light of any wavelength in the range 200 to 800 nm through a sample 10 cm thick is at least 4%. Similarly, a composition or portion is deemed to be translucent if such light through the sample is between 0.01% and 5%, usually no higher than 1%. The term opaque means that the maximum transmittance of such light is below 0.01%. Transmittance can be easily measured by placing a sample of the required thickness in the light path of a UV-VIS Spectrophotometer such as the Hewlett-Packard 8451A Diode Ray Spectrophotometer. The advantage of this method of assessing transparency is that it is highly sensitive to optical clarity while independent of color.

DETAILED DESCRIPTION OF THE DRAWING

Further objects, advantages and features of the present invention will become more apparent through consideration of the following drawing in which.

DETAILED DESCRIPTION OF THE INVENTION

Now it has been found that a cosmetic product can be sold within a package which allows for improved aesthetics. Customers can simultaneously view contents of the package in a light illuminated manner by an arrangement also serving as a 3-dimentional logo. Other less aesthetic components of the package (e.g. pump mechanisms) can be hidden from view.

Figure 1:
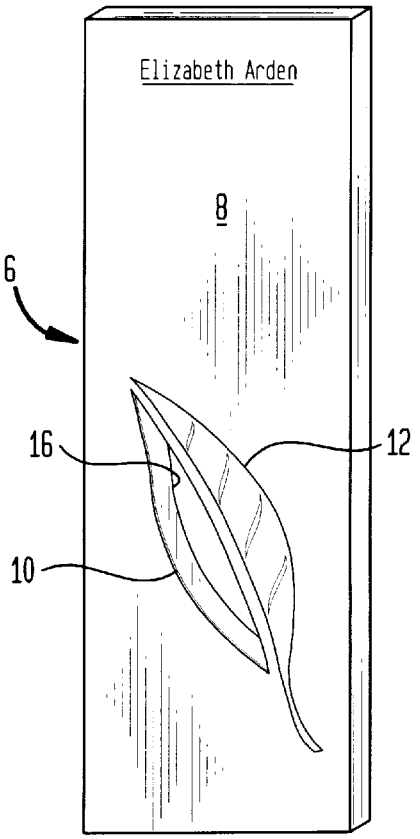
FIG. 1 is a front elevational view of an empty carton according one embodiment of the present invention.

Packaged cosmetic products of the present invention include a transparent cosmetic composition 2, a container 4 for holding the composition and an outer protective carton 6 surrounding the container. FIG. 1 shows a front face of the empty carton 6 formed with an anterior wall 8 and a window 10 cut through the anterior wall. In this embodiment the carton is rectangular in shape with top, side and bottom walls including respective flaps all of which are conventional and are therefore not shown. A half leaf 12 is embossed onto the surface of the anterior wall. In different embodiments, the leaf may be printed or otherwise represented on the anterior wall. It is to be understood that the invention may encompass other designs, letters, numerals and is not merely limited to leaves or any particular leaf pattern.

In the embodiment of FIG. 1, window 10 has a geometry generally complementary to that of leaf 12 to provide the impression of a unified design (e.g. representing the left half of leaf).

Figure 2:
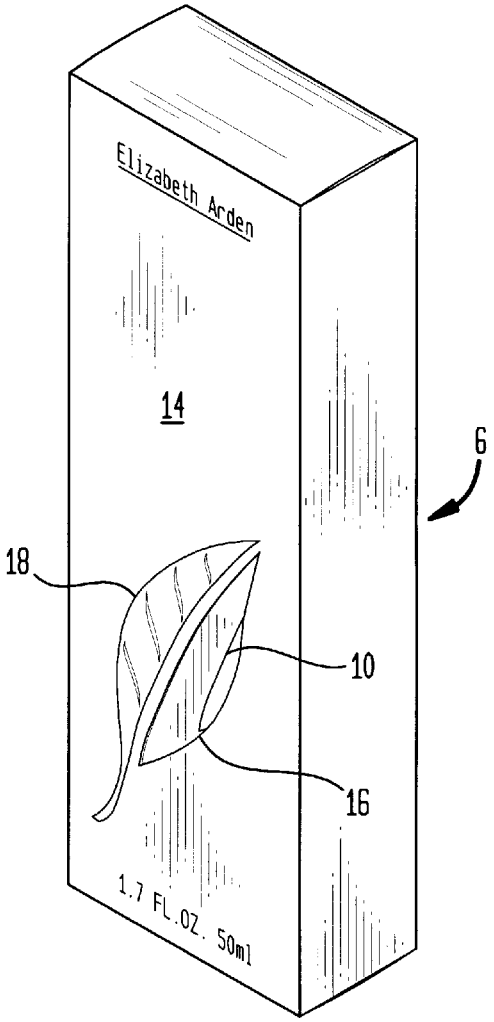
FIG. 2 is a rear perspective view of the carton according to FIG. 1.

FIG. 2 provides a prospective rear view of carton 6 having a posterior wall 14. A second window 16 symmetrical in shape to the first window 10 is cut through the posterior wall. A second half-leaf pattern 18 is embossed into the posterior wall adjacent the second window. Both windows 10, 16 are aligned with one another thereby permitting light to travel through both the anterior and posterior walls. For purposes of this invention, the windows are preferably of identical shape but may also differ from one another so long as they are aligned for light transmittance between them along a common viewing pathway.

Figure 3:
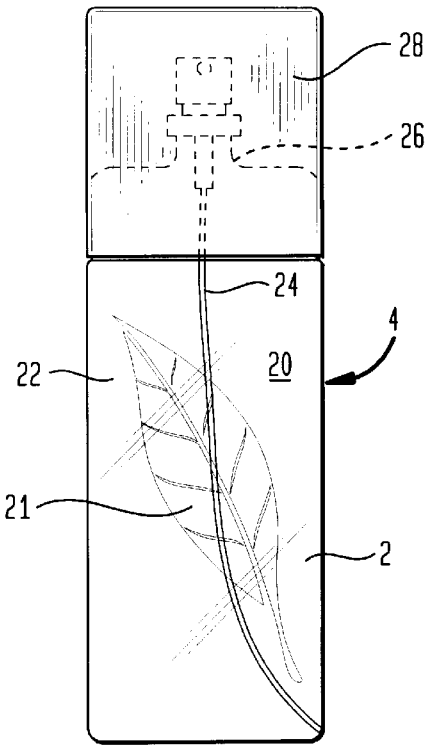
FIG. 3 is a front elevational view of a container holding a transparent cosmetic composition.
Figure 4:
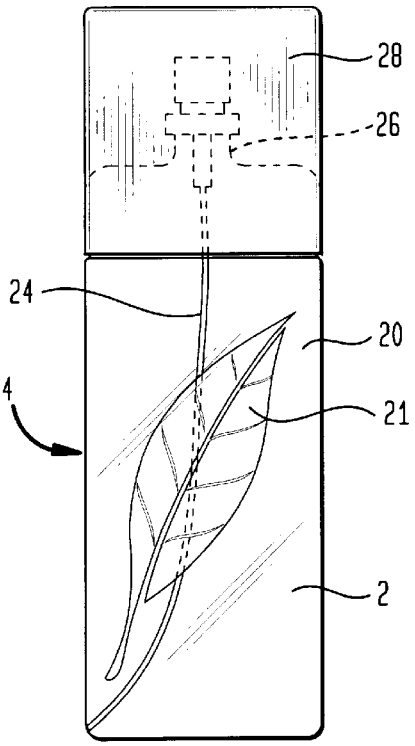
FIG. 4 is a rear view of the container according to FIG. 3.

FIG. 3 provides a view of a transparent glass container 4 formed with front and rear walls 20, 22. FIG. 4 best illustrates a rear perspective view of the container. Etched into posterior wall 22 is a translucent leaf pattern matching that of the complementary leaf and window halves formed in the anterior and posterior walls of the carton.

The cosmetic composition 2 is held within the container. In a preferred embodiment, the composition is a transparent pumpable fluid of the eau de toilette (perfume) variety. FIGS. 3–4 show a siphon tube 24 for drawing the composition from the container by a spray pump 26 mechanism. An overcap 28 covers the spray mechanism for storage purposes. Advantageously the transparent cosmetic composition may be tinted with color such as a green dye to harmonize with the leaf pattern. Colorants other than green may of course be utilized so as to be harmonious with the selected design and theme of the packaged cosmetic product.

Figure 5:
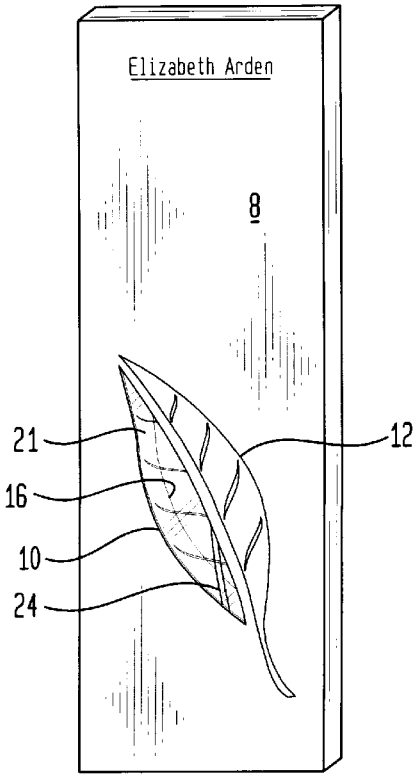
FIG. 5 is the packaged cosmetic product according to the present invention wherein the container is stored within the carton.

FIG. 5 shows the full packaged product wherein the container 4 is placed inside of the carton 6. Placement is such that the rear wall of the container is adjacent the posterior wall of the carton. Likewise the front wall of the container is positioned juxtaposed against the anterior wall of the carton. A customer viewing the product through the first window 10 can see directly through the green dyed transparent cosmetic composition to observe the translucent etched portion 21. Potential customers can thereby view the product without unwrapping. Moreover the window pair becomes an integral part of the representative icon in a two-layered effect resulting in a 3-dimentional logo. The pump mechanism and opaque cap portions of the package are hidden from view to improve aesthetics.

The foregoing illustrates only a select embodiment of the present invention. Numerous modifications and changes are expected to readily occur to those skilled in the art, all of which are within the purview and scope of the present invention.

What is claimed is:

1. A packaged cosmetic product comprising:

(i) a transparent cosmetic composition;

(ii) a container formed with front and rear walls, one of the walls being transparent along at least a portion of a surface thereof and one of the walls being translucent along at least a portion of a surface thereof, the composition being held within the container; and (iii) a carton formed with anterior and posterior walls parallel to one another, the walls of the carton being opaque except for a window in each of the anterior and posterior walls, the windows being aligned with one another, the container being stored within the carton in a position framing the translucent portion within one of the windows and the transparent portion within the other of the windows.

2. The product according to claim 1 wherein the container walls are of glass and the translucent portion is etched glass.

3. The product according to claim 1 further comprising a design formed on the anterior wall of the carton, the design being symmetrical in shape to that of the windows.

4. The product according to claim 3 wherein the design is that of half a leaf.

5. The product according to claim 1 wherein the translucent portion covers an area larger than the window.

6. The product according to claim 1 wherein the walls of the carton are paperboard.

7. The product according to claim 1 wherein the composition is a sprayable fluid.

8. The product according to claim 1 wherein the container further comprises a pump mechanism hidden from view by walls of the carton.

9. The product according to claim 1 wherein the composition is a perfume.

10. The product according to claim 1 wherein the front wall is transparent and the rear wall is translucent along at least a portion of a surface thereof.

11. The product according to claim 10 wherein the container is stored within the carton in a position framing the translucent portion within the posterior window and the transparent portion within the anterior window.

* * * * *